US007740297B2

(12) United States Patent
Howie

(10) Patent No.: US 7,740,297 B2
(45) Date of Patent: Jun. 22, 2010

(54) HANGER SAVER

(76) Inventor: Christopher Howie, 191 Park Avenue, Newmarket, Ontario (CA) L3Y 1T9

( * ) Notice: Subject to any disclaimer, the term of this patent is extended or adjusted under 35 U.S.C. 154(b) by 0 days.

(21) Appl. No.: 12/076,292

(22) Filed: Mar. 17, 2008

(65) Prior Publication Data

US 2009/0230708 A1 Sep. 17, 2009

(51) Int. Cl.
*A45F 5/00* (2006.01)

(52) U.S. Cl. ..... 294/142; 294/137

(58) Field of Classification Search ..... 294/137, 294/142, 143, 145; 223/88–91; 224/313, 224/927

See application file for complete search history.

(56) References Cited

U.S. PATENT DOCUMENTS 1,182,583 A * 5/1916 Nielsen ..... 294/137
2,412,735 A * 12/1946 Isaak ..... 223/88
2,596,745 A * 5/1952 Waldman ..... 223/88
3,226,147 A * 12/1965 Marshall ..... 294/99.1
3,348,745 A * 10/1967 Basile et al. ..... 223/88
3,606,967 A * 9/1971 Roberts ..... 294/143
3,633,802 A 1/1972 Webster
4,557,516 A * 12/1985 Usner ..... 294/143
4,824,156 A 4/1989 Greene
5,330,244 A * 7/1994 Rodwell ..... 294/143
5,524,948 A 6/1996 Bostwick

* cited by examiner

*Primary Examiner*—Dean J Kramer
(74) *Attorney, Agent, or Firm*—Neil H. Hughes

(57) ABSTRACT

A garment hanger carrier comprising an elongated body having a top and bottom and two sides, a channel provided proximate the bottom of the body and extending from side to side for receiving the garment hangers, a rail disposed proximate the bottom of the body and extending from side to side thereof below the channel for supporting the garment hangers and a carrying device for suspending the garment hanger carrier from a rail, rod or bracket wherein the garment hanger carrier may be used to carry and support a plurality of garment hangers.

4 Claims, 4 Drawing Sheets

HANGER SAVER

FIELD OF THE INVENTION

This invention relates to a device for collecting and carrying garment hangers in an organized fashion.

BACKGROUND OF THE INVENTION

The carrying of garment hangers can be a particularly cumbersome task especially if the hangers are laden with heavy coats or other clothes. Compounding the difficulty is if several hangers need to be transported. These problems are encountered often by individuals who need to travel with a number of hanging garments or who carry clothes to and from dry cleaners or laundromats.

A number of devices for organizing and carrying clothes hangers have been reported in the prior art. All employ some sort method for comfortably carrying several clothes hangers:

U.S. Pat. No. 5,524,948 describes a C-shaped clothes hanger carrier that can be carried by hand. The carrier is constructed in two pieces. The operation of the carrier involves the tilting of the carrier to allow the tips of the clothes hangers to be inserted into the carrier. The main drawbacks with this device are the need to tilt the device in order to insert the clothes hangers which can be cumbersome, particularly if the hangers are laden with heavy clothes, and the two-piece construction complicates manufacturing and assembly of such a device.

U.S. Pat. No. 3,633,802 describes a clothes hanger carrier which has a finite number of holes to accommodate individual clothes hanger hooks. The main drawbacks of this device are the need to tilt the device in order to insert the clothes hangers, which can be cumbersome, and the multi-piece construction would make manufacturing complicated.

U.S. Pat. No. 4,824,156 describes a wire loop having a hand grip for carrying clothes hangers. The main drawbacks are the circular holder will allow the clothes hangers to bunch up and potentially wrinkle whatever clothes are on them, and the multi-piece construction complicates its manufacture. In addition, the use of a traditional handle precludes the device from being hanged from a standard clothes hanger rod.

It is therefore an object of this invention to provide a garment hanger carrier for organizing and carrying one or a plurality of garment hangers.

It is another object of this invention is to provide a one-piece garment hanger carrier made from inexpensive, light-weight material.

It is yet another object of this invention to provide a garment hanger carrier in which a single or plurality of garment hangers can be inserted and easily carried.

Further and other objects will be apparent to those skilled in the art when considering the following summary of the invention and the preferred embodiments thereof illustrated herein.

SUMMARY OF THE INVENTION

This invention relates to a device for collecting and carrying one or a plurality of garment hangers. The garment hangers contemplated to be collected and carried can be the standard wire type often used by dry cleaning establishments. The garment hanger carrier of the present invention comprises an elongated body having a top and bottom and two sides, a channel provided proximate the bottom of the body and extending from side to side for receiving the garment hangers, a rail disposed proximate the bottom of said body and extending from side to side thereof below said channel and for supporting said garment hangers, said rail extending upwardly at one end to form a second top member, a first top member provided above said channel proximate one side of said body and including a center supporting part, a second top member provided above said channel proximate a second side of said body and being disjointed from said first top member separated by a space or gap for receiving the hook of the garment hangers, and a carrying device supported proximate the top of said center supporting part extending away from said center supporting part for suspending said carrying device from a rail, rod or bracket wherein said carrying device may be used to carry and support a plurality of garment hangers. The carrying device can be in the form of a hook or a peg for hanging the garment hanger carrier on a standard garment hanger rod, allowing the collected and carried garment hangers to hang in a normal orientation, that is as if they were individually hung on the garment hanger rod. Optionally, the hook can rotated around an axis so that the garment hanger carrier can swivel independently of the hook. This may be particularly useful in certain situations when a hook as opposed to a rod is used to hang the garment hanger carrier.

The body of the garment hanger carrier forms the main structure of the device and can assume any two-dimensional geometric shape. The most preferred shape is triangular due to its inherent strength and the fact that it allows the second top member to contact the first top member forming a wedge-like contact preventing the garment hangers from falling out. Optionally, an advertisement or other such information or promotion item may be affixed to the body.

The space or gap is formed between the second top member and the first top member and is preferably offset to one side of the body. The space or gap so produced by the second top member and the first top member can assume one of two positions, an open position when the first top member and second top member are apart or a closed position when the first top member and the second top member contact. In the open position, garment hangers are introduced into the garment hanger carrier and are collected along the rail. The weight of the garment hangers on the rail causes the space or gap to close, preventing any garment hangers from inadvertently falling out. In another aspect of the invention, the second top member and the first top member are oriented at an angle to each other so that in the closed position the second top member and first top member form a wedge-like contact. This wedge-like contact is one that increases in strength as more weight is added to the rail.

The rail is provided proximate the bottom of the body of the garment hanger carrier and along which the garment hangers are collected. The rail runs the length of the body. The rail is flexible yet strong so that a plurality of garment hangers can be collected and carried by the garment hanger carrier. It is also this flexibility that allows the space or gap to assume a closed position to prevent the garment hangers from inadvertently falling out.

In another aspect of this invention, the garment hanger carrier is formed, for example, from a molded one piece of material. The material can be light-weight yet strong with some flexibility and may include polymers and metals. The material is preferably a plastic, most preferably a polyolefin such as, but not limited to, polyethylene, polypropylene or the like.

DETAILED DESCRIPTION OF THE INVENTION

Figure 1:
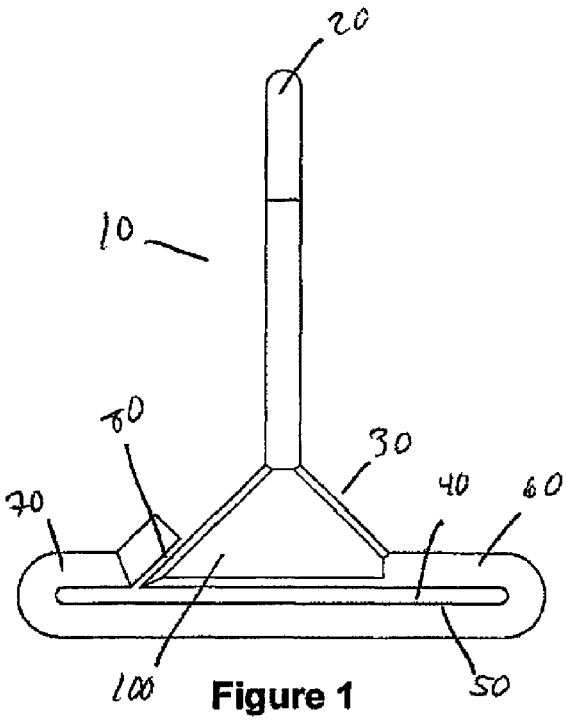
FIG. 1 is the front view of a preferred embodiment of the garment hanger carrying device.
Figure 3:
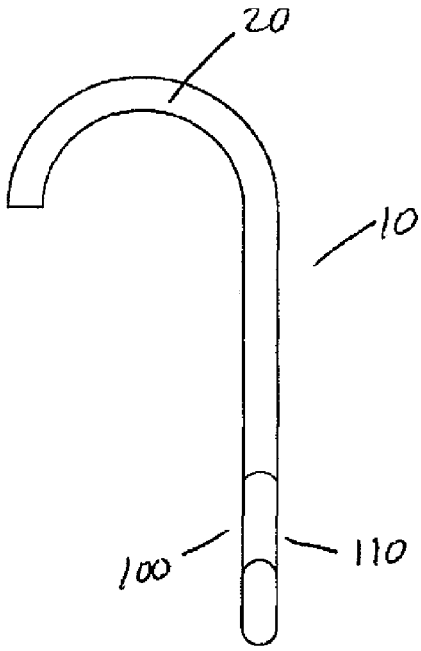
FIG. 3 is the left side view of a preferred embodiment of the garment hanger carrying device.
Figure 2:
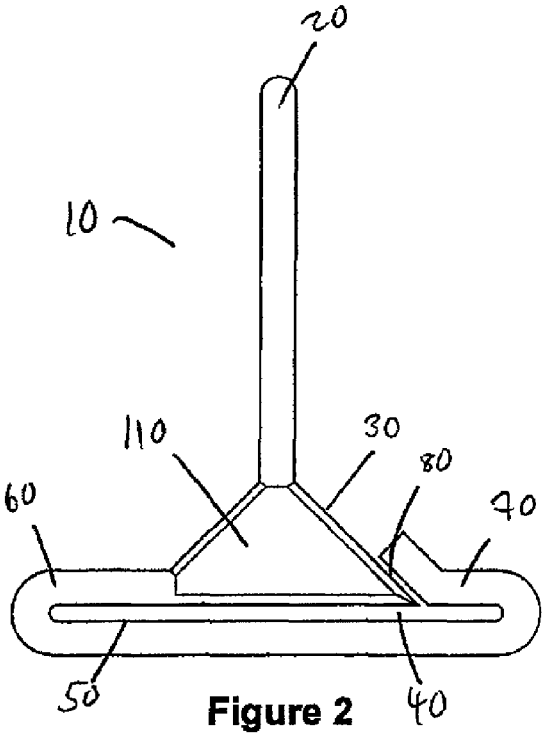
FIG. 2 is the rear view of a preferred embodiment of the garment hanger carrying device.
Figure 4:
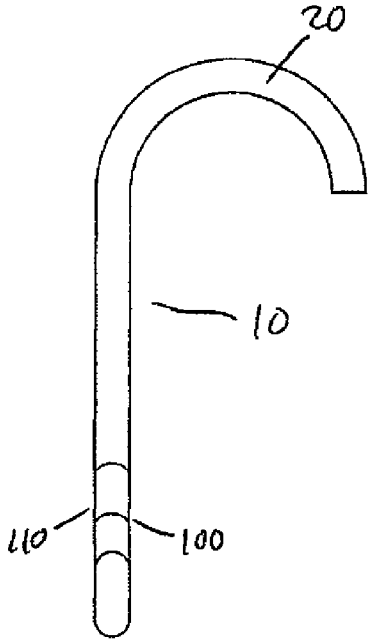
FIG. 4 is the right side view of a preferred embodiment of the garment hanger carrying device.
Figure 5:
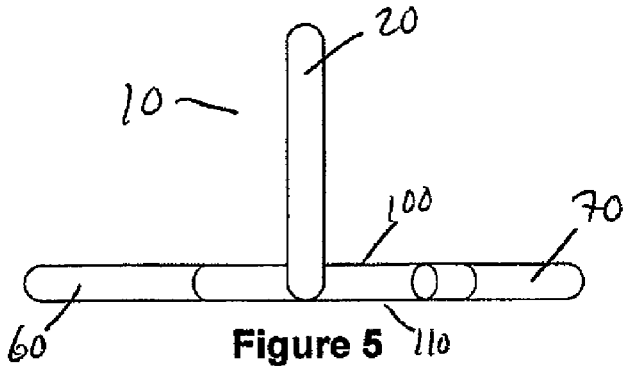
FIG. 5 is the top view of a preferred embodiment of the garment hanger carrying device.
Figure 6:
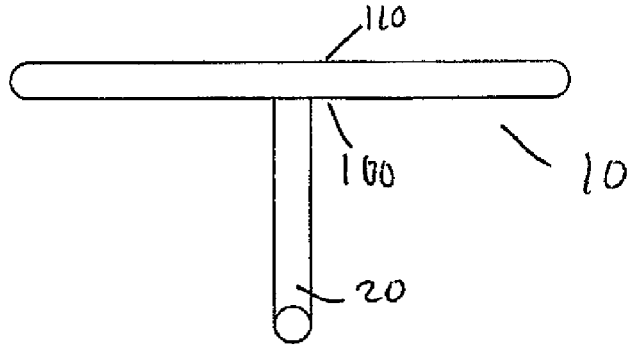
FIG. 6 is the bottom view of a preferred embodiment of the garment hanger carrying device.
Figure 7:
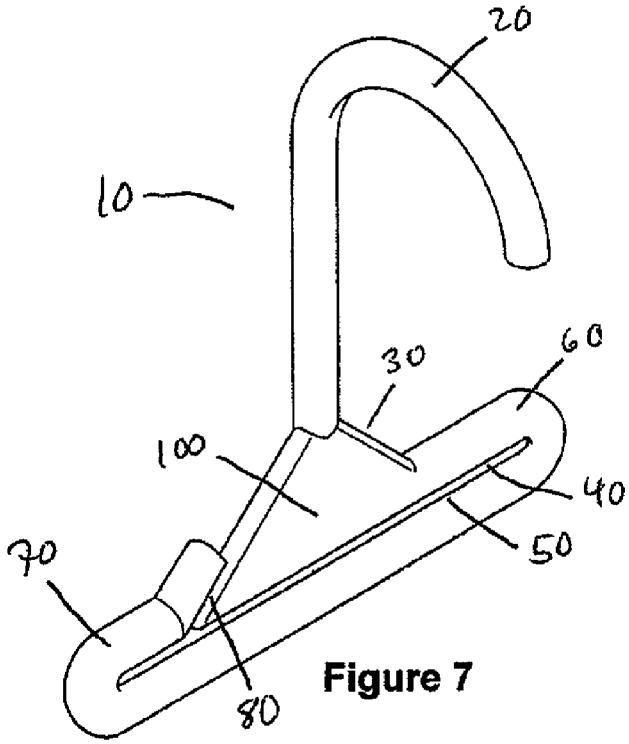
FIG. 7 is a projected view of a preferred embodiment of the garment hanger carrying device.
Figure 8:
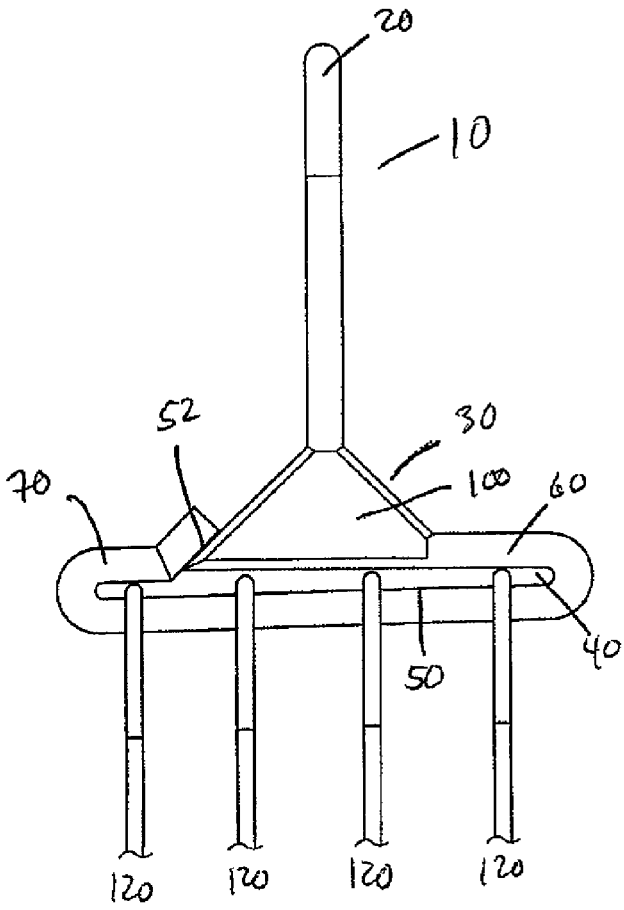
FIG. 8 is a front view of a preferred embodiment of the garment hanger carrying device in which garment hangers have been placed.
Figure 9:
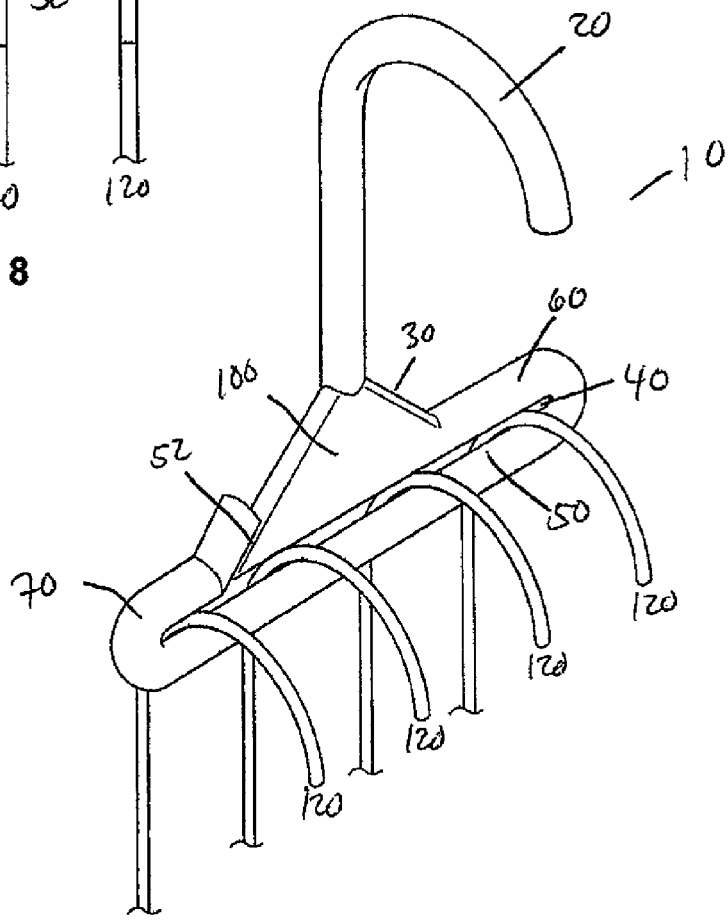
FIG. 9 is a projected view of a preferred embodiment of the garment hanger carrying device in which garment hangers have been placed.
Figure 10:
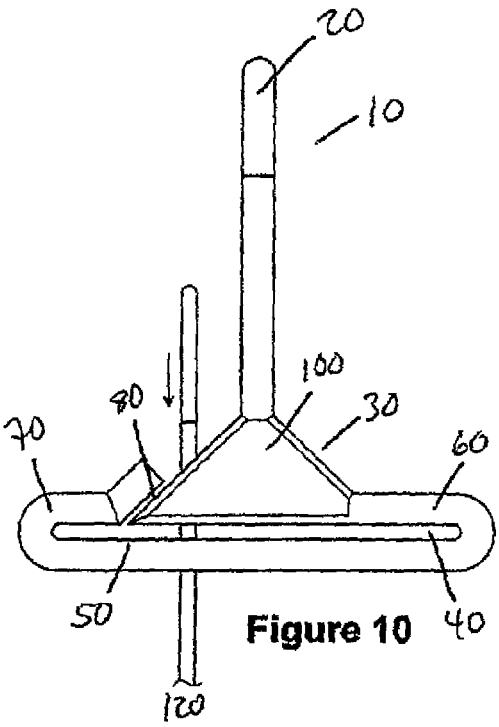
FIGS. 10-13 are front views of a preferred embodiment of the garment hanger carrying device and demonstrate the insertion and carrying of garment hangers.
Figure 12:
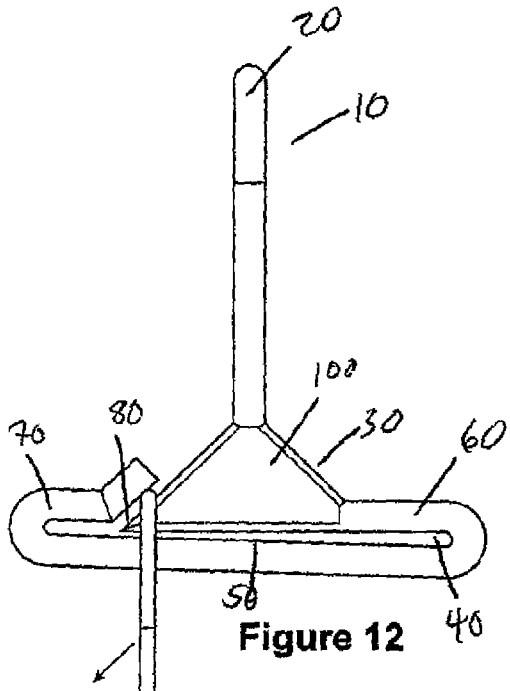
Figure 11:
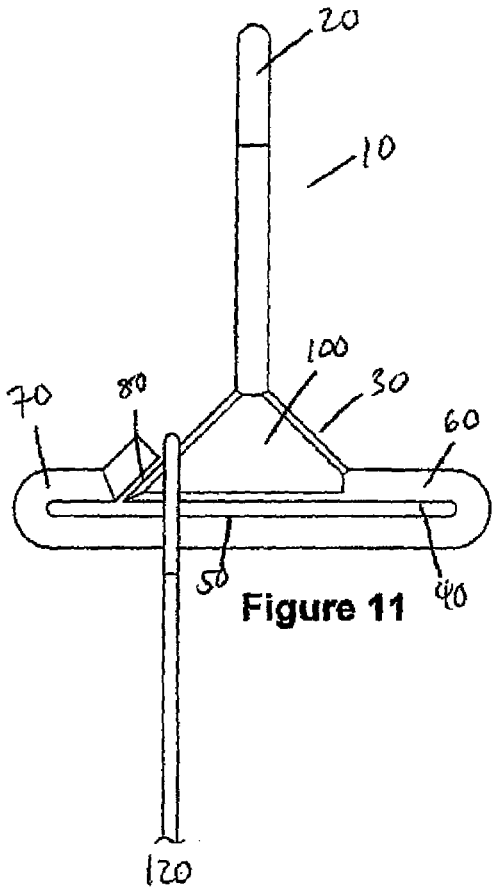
Figure 13:
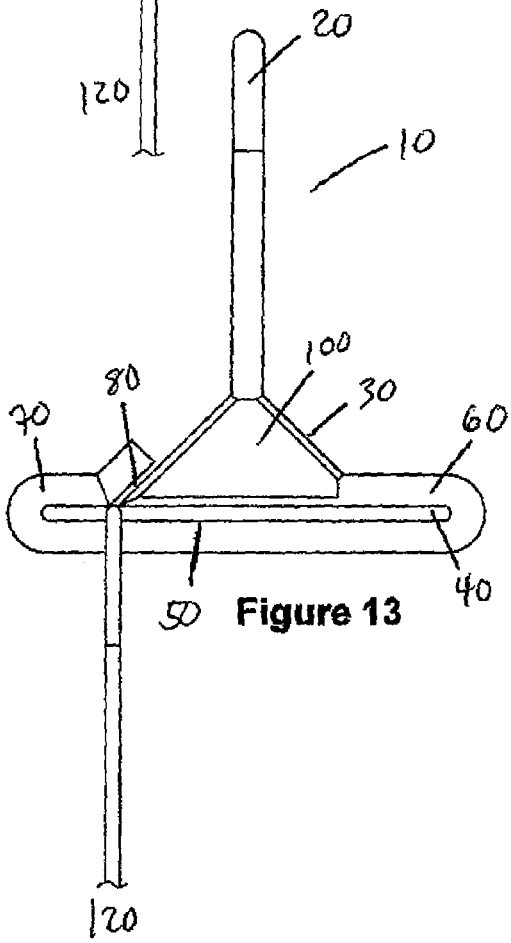

With specific reference to the above figures the garment hanger carrier (10) is comprised of a hook (20), a body (30), a channel (40), a rail (50), a first top member (60), a second top member (70), space or gap (80), a first side (100) and a second side (110). The hook is rigidly attached to the first top member such that it extends upwardly away from the body and normal thereto to facilitate easy hanging of the carrier on any standard garment hanger rod or rail. In a preferred embodiment, the hook is offset from the centre axis of the body away from the space or gap. The body of the carrier is solid, one-piece and triangular in shape to provide greater strength. The body has two sides to allow advertising or other information to be affixed to the body. Running along the bottom of the body is the rail. The rail is affixed to the body at a first side to form a first top member. On the second side, the second top member is disjointed from the first top member. The space or gap is formed at the disjoint of the second top member and the first top member and allows for garment hangers (120) to be inserted into the garment hanger carrier. Given the flexible nature of the second top member this space or gap can be closed in a wedge-like fashion (52) upon application of force to the rail normal to the body. This force comes from the weight of garment hangers positioned along rail.

The garment hanger carrier functions as follows: one or several garment hangers are inserted through the space or gap and travel along the rail. The carrier loaded with garment hangers is lifted by the user at the hook and the weight of the garment hangers positioned along the rail causes the rail to deform away from the body which causes the second top member and the first top member to form a wedge-like contact. The weight of the garment hangers closes the space or gap and prevents any inadvertent release of the garment hangers. In addition, as more weight is applied to the rail, the second top member and the first top member are wedged tighter together further ensuring no release of the garment hangers.

In a preferred embodiment the garment hangers and the hook are oriented parallel to each other. Thus, the garment hanger carrier can be hung on a standard coat hanger rail and all the garment hangers will be positioned offset but along the plane of the coat hanger rail. This ensures efficient use of space and keeps any recently cleaned and pressed clothes wrinkle-free while hanging on the garment hangers.

As many changes can be made to the invention without departing from the scope of the invention; it is intended that all material contained herein be interpreted as illustrative of the invention and not in a limiting sense.

While the foregoing provides a detailed description of a preferred embodiment of the invention, it is to be understood that this description is illustrative only of the principles of the invention and not limitative. Furthermore, as many changes can be made to the invention without departing from the scope of the invention, it is intended that all material contained herein be interpreted as illustrative of the invention and not in a limiting sense.

The invention claimed is:

1. A garment hanger carrier comprising:

i) an elongated body having a top and bottom and two sides;

ii) a channel provided proximate the bottom of the body and extending from side to side for receiving the garment hangers;

iii) a deformable rail disposed proximate the bottom of said body and extending from side to side thereof below said channel and for supporting said garment hangers, said rail extending upwardly at each end to form a first and a flexible second top member;

iv) the first top member provided above said channel proximate one side of said body, including a centre supporting part and a triangular portion;

v) the flexible second top member provided above said channel proximate a second side of said body and being disjointed from said first top member defining an open position separated by a space or gap for receiving the garment hangers and wherein said first top member and said flexible second top member upon application of a force from the weight of garment hangers positioned along the deformable rail form a wedge-like contact between said first top member and said flexible second top member in a closed position;

vi) a carrying device supported proximate the top of said center supporting part extending away from said center supporting part for suspending said carrying device from a rail, rod or bracket; and v) wherein said carrying device may be used to carry and support a plurality of garment hangers.

2. The garment hanger carrier of claim 1 wherein the carrying device is a hook.

3. The garment hanger carrier of claim 1, or 2 wherein the carrier is composed of a polymer or a metal.

4. The garment hanger of any carrier of claim 1 or 2 wherein the wedge-like contact increases in strength as more weight is added to the rail.

* * * * *